US008615185B2

(12) United States Patent
Mor-Yosef et al.

(10) Patent No.: US 8,615,185 B2
(45) Date of Patent: Dec. 24, 2013

(54) DEVICE FOR HOLDING A PHOTORECEPTOR SHEET

(75) Inventors: Avichay Mor-Yosef, Jerusalem (IL); Elad Taig, Ramat Gan (IL); Haggai Abbo, Kyriat Ono (IL); Gilad Tzori, Moshav Satariyya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 738 days.

(21) Appl. No.: 12/681,011

(22) PCT Filed: Oct. 23, 2007

(86) PCT No.: PCT/US2007/082224

§ 371 (c)(1),
(2), (4) Date: Apr. 28, 2010

(87) PCT Pub. No.: WO2009/054846

PCT Pub. Date: Apr. 30, 2009

(65) Prior Publication Data

US 2011/0182622 A1 Jul. 28, 2011

(51) Int. Cl.
*G03G 15/00* (2006.01)

(52) U.S. Cl.
USPC ..... 399/159; 399/161

(58) Field of Classification Search
USPC ..... 399/159, 161
See application file for complete search history.

(56) References Cited

U.S. PATENT DOCUMENTS

| | | | | | |
|---|---|---|---|---|---|
| 3,600,086 | A * | 8/1971 | Cates et al. | 399/161 |
| 3,706,489 | A * | 12/1972 | Moxness et al. | 399/161 |
| 4,076,410 | A * | 2/1978 | Kono et al. | 399/161 |
| 4,102,570 | A * | 7/1978 | Shimoda | 399/161 |
| 4,179,211 | A * | 12/1979 | Kimura et al. | 399/21 |
| 4,784,928 | A * | 11/1988 | Kan et al. | 430/59.6 |
| 5,101,234 | A * | 3/1992 | Suzuki et al. | 399/161 |
| 5,255,056 | A * | 10/1993 | Preszler et al. | 399/161 |
| 5,516,096 | A * | 5/1996 | Whiteside et al. | 271/277 |
| 5,669,043 | A * | 9/1997 | Nishino et al. | 399/116 |
| 5,732,632 | A * | 3/1998 | Oomoto et al. | 101/483 |
| 6,829,454 | B2 * | 12/2004 | Miyakawa et al. | 399/159 |
| 2003/0068570 | A1 * | 4/2003 | Landa et al. | 430/116 |

FOREIGN PATENT DOCUMENTS

| | | | |
|---|---|---|---|
| DE | 2632182 | A1 | 1/1978 |
| DE | 3041302 | A1 | 6/1982 |
| JP | 54026104 | A | 2/1979 |
| JP | 05004328 | A | 1/1993 |

OTHER PUBLICATIONS

Written Opinion of Intl Search Authority in PCT/US2007/08224 dated Mar. 31, 2010.*
Coiling Technologies Inc., Wave Springs, copyright 2011, printed Oct. 1, 2012.*

* cited by examiner

*Primary Examiner* — Walter L Lindsay, Jr.
*Assistant Examiner* — David Bolduc

(57) ABSTRACT

A device for holding a photoreceptor sheet onto a drum of an electro-photography printing device comprises first and second holding surfaces that are configured to hold an edge of the photoreceptor sheet from opposite directions by pressing against the sheet in a substantially perpendicular direction with respect to the surface of the sheet, wherein at least the second holding surface is pre-loaded.

22 Claims, 5 Drawing Sheets

DEVICE FOR HOLDING A PHOTORECEPTOR SHEET

BACKGROUND

Electro-photography printing devices including photoreceptors for creating a latent image that may be subsequently developed and printed are known in the art. Typically, the photoreceptor is made up of a thin photoreceptor sheet attached to a rotatable drum. Typically, the photoreceptor sheet is periodically replaced due to damage. During operation, a charger uniformly charges the photoreceptor. The drum is rotated and a laser writer discharges the photoreceptor in selected areas to create a latent image. Continued rotation of the drum brings the selectively charged photoreceptor into contact engagement with a developer roller for developing the latent image. The developed latent image is then transferred to a desired substrate. Alternatively, there may be provided an intermediate transfer member, which may be a drum or belt and which is in operative engagement with the photoreceptor bearing the developed image One system is described in U.S. Pat. No. 5,508,790 to Belinkov et al. entitled "Photoreceptor Sheet and Imaging System Utilizing Same" which is incorporated herein by reference.

BRIEF DESCRIPTION OF THE DRAWINGS

The subject matter regarded is particularly and distinctly claimed in the concluding portion of the specification. Non-limiting examples of embodiments of the present invention are described below with reference to figures attached hereto, which are listed following this paragraph. In the figures, identical structures, elements or parts that appear in more than one figure are generally labeled with a same symbol in all the figures in which they appear. Dimensions of components and features shown in the figures are chosen for convenience and clarity of presentation and are not necessarily shown to scale. For example, the dimensions of some of the elements may be exaggerated relative to other elements for clarity.

Figure 1:
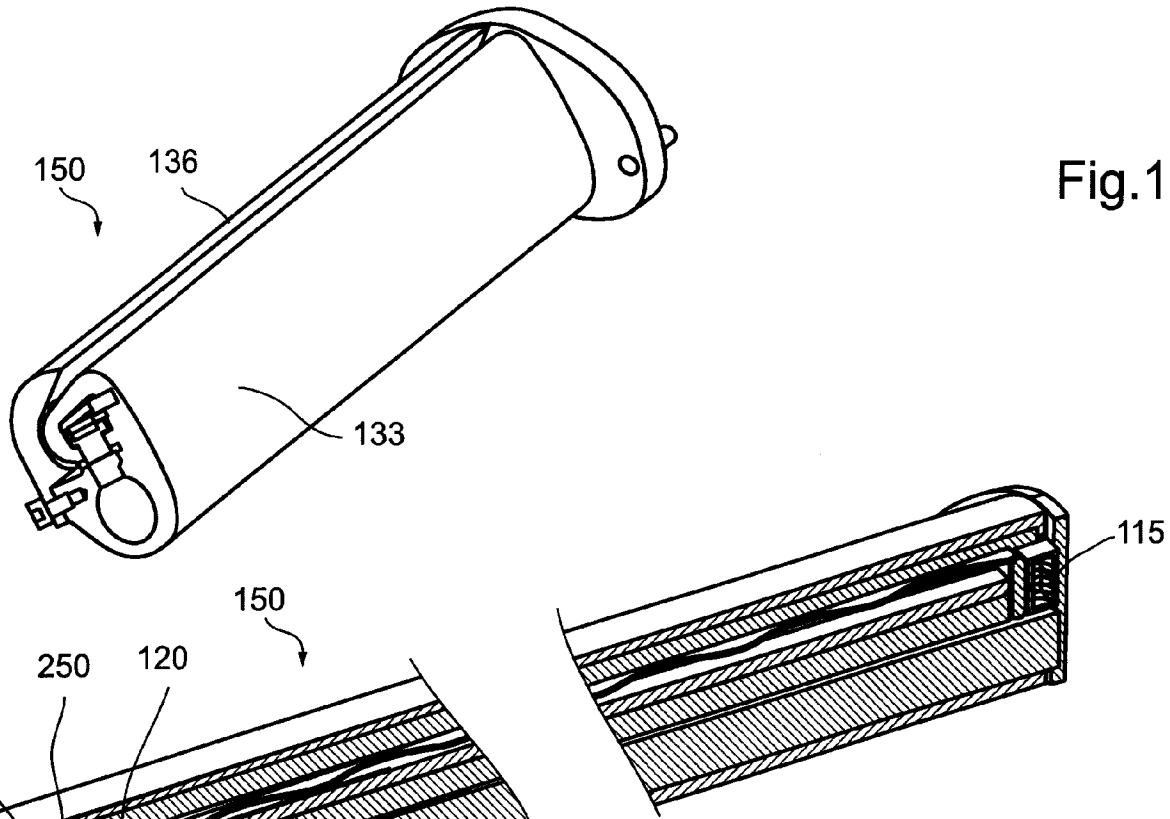
FIG. 1 is a holding device according to some embodiments of the present invention.
Figure 2:
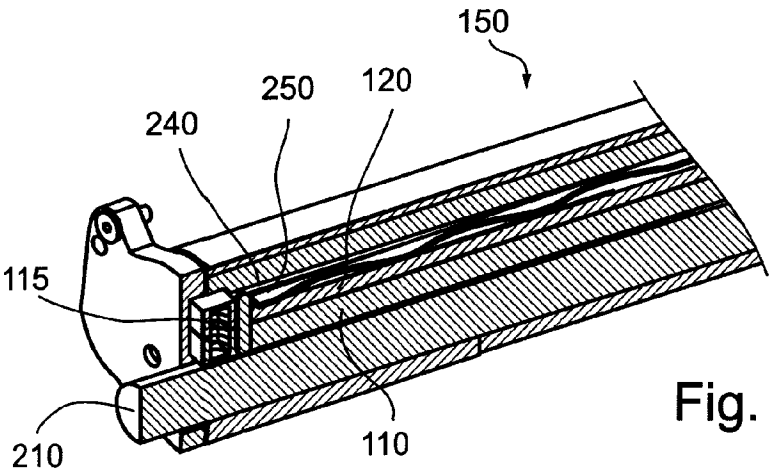
FIG. 2 is a longitude sectional view of a holding device according to some embodiments of the present invention.

It will be appreciated that for simplicity and clarity of illustration, elements shown in the figures have not necessarily been drawn to scale. Further, where considered appropriate, reference numerals may be repeated among the figures to indicate corresponding or analogous elements.

DETAILED DESCRIPTION OF EXEMPLARY EMBODIMENTS

In the following description, exemplary, non-limiting embodiments of the invention incorporating various aspects of the present invention are described. For purposes of explanation, specific configurations and details are set forth in order to provide a thorough understanding of the embodiments. However, it will also be apparent to one skilled in the art that the present invention may be practiced without the specific details presented herein. Furthermore, well-known features may be omitted or simplified in order not to obscure the present invention. Features shown in one embodiment may be combined with features shown in other embodiments. Such features are not repeated for clarity of presentation. Furthermore, some unessential features are described in some embodiments.

In the design of a faster printer, the present inventors have found that the lifespan of the photoreceptor sheet has been further limited. It has been found that faster printing increases the stresses on the photoreceptor and periodically leads to disengagement of the photoreceptor from the drum and/or mechanical damage to the thin photoreceptor sheet. This reduces its lifetime.

An aspect of some embodiments of the invention is the provision of an improved device for holding a thin photoreceptor sheet onto a drum of an electro-photography printing device.

According to some embodiments of the present invention, the improved device includes a holding surface engaging the sheet by moving toward the sheet in a substantially perpendicular direction to the surface of the sheet. Force is transmitted to the sheet over a surface area engaged with the holding surface facilitating substantially uniform holding pressure over that area. The holding surface is an improvement over existing devices that engage the sheet by rotating an element that is substantially tapered and/or a leaf spring that engages the sheet over a line. The tapered end of the rotating element presses the sheet against a wall, transmitting force to the sheet over a line and/or over a minimal area. Providing a holding surface that engages the sheet in a substantially perpendicular direction as is provided in embodiments of the present invention, increases the holding robustness of the device and reduces stresses imposed on the sheet that can lead to damage of the sheet.

According to some embodiments of the present invention, the holding surface is an end surface of a clamping element that slides along a channel. In some exemplary embodiments, the clamping element rests on a rotatable shaft that is operative to translate the clamping element responsive to a rotation of the shaft. In some exemplary embodiments, the shaft engages the clamping element on a surface opposite that of the holding surface.

According to some embodiments of the present invention, a second clamping element engages the sheet from an opposite direction. In some exemplary embodiments, the second clamping element is preloaded by a spring. The preload spring can be positioned in a number of locations with respect to the second clamping element. In some exemplary embodiments, the spring is a wave spring having a length substantially corresponding to a length of the sheet. In some exemplary embodiments, the preload force of the spring is adjustable. In some exemplary embodiments adjustment to the preload force is facilitated with a slider and an associated set screw operative to press against the spring.

According to some embodiments of the present invention, the improved device includes a substantially rigid holding surface backed by a pre-loaded spring. The holding surface engages the sheet by moving toward the sheet in a substantially perpendicular direction to the surface of the sheet and engages the sheet over a substantially flat surface. As is described herein above, force is transmitted to the sheet over the surface area of the holding surface facilitating substantially uniform holding pressure over the surface area of the sheet engaged with the holding surface.

An aspect of some embodiments of the present invention is the provision of an improved device for removably holding a thin photoreceptor sheet onto a drum of an electro-photography printing device. According to some embodiments of the present invention the device includes a handle that can, by rotation, effect engagement and/or disengagement of the photoreceptor sheet from the drum. In some exemplary embodiments, the handle is fixed to the rotating shaft described above.

According to some embodiments of the present invention, the device includes a mechanism handle for engagement and/or disengagement of the photoreceptor sheet from the drum. In some exemplary embodiments, at least one part of the mechanism handle is fixed to the shaft while other parts are attached to drum. According to some embodiments of the present invention, the mechanism handle eases operation of the device for holding the thin photoreceptor sheet onto the drum, e.g. reduces the force employed for operating the device.

An exemplary embodiment of the present invention provides a device for holding a photoreceptor sheet onto a drum of an electro-photography printing device comprising first and second holding surfaces that are configured to hold an edge of the photoreceptor sheet from opposite directions by pressing against the sheet in a substantially perpendicular direction with respect to the surface of the sheet, wherein at least the second holding surface is pre-loaded.

In some embodiments, the first and the second holding surfaces are surfaces of a corresponding first and second clamping element.

In some embodiments, at least the first clamping element rests on a rotatable shaft.

In some embodiments, the first clamping element approaches and recedes from the second holding surface in response to rotation of the shaft.

In some embodiments, the shaft has a cross sectional shape that includes a circular portion and a flat portion.

In some embodiments, the first clamping element recedes from the second clamping element in response to the first clamping element resting on the flat portion of the shaft.

In some embodiments, at least one of the first or the second holding surface is pre-loaded by a spring.

In some embodiments, the spring is a wave spring.

In some embodiments, the length of the spring corresponds to at least the length of the edge of the photoreceptor sheet.

In some embodiments, the spring is a leaf spring.

In some embodiments, the spring rests on the second clamping element on a surface opposite the holding surface of the second clamping element.

In some embodiments, the device comprises a sliding element at least partially resting on the spring and a set screw configured to translate the sliding element over the spring.

In some embodiments, the sliding element and the set screw are configured for adjusting the pre-load of the spring.

In some embodiments, the drum includes a slot on the perimeter of the drum and wherein the device is positioned on the drum proximal to the slot so that the slot forms an entryway into the device.

In some embodiments, the device comprises a handle fixed to the rotatable shaft, wherein the handle is operative to hold and release the photoreceptor sheet from the drum.

In some embodiments, the photoreceptor sheet is a foil.

In some embodiments, the photoreceptor sheet has a thickness between 0.07 and 0.11 mm.

In some embodiments, the device applies a holding force at least 250 Kg on the photoreceptor sheet.

In some embodiments, the device applies a holding pressure of at least 70 MPa.

In some embodiments, the device is configured for removably fixing the photoreceptor sheet onto the drum.

In some embodiments, the device is configured for providing an electrical path between the photoreceptor sheet and the drum.

An exemplary embodiment of the present invention provides a device for holding a photoreceptor sheet onto a drum of an electro-photography printing device, the device comprising first and second holding surfaces that are configured to clamp an edge of the photoreceptor sheet from opposite directions by pressing against the sheet in a substantially perpendicular direction with respect to the surface of the sheet, and a handle associated with the holding device, wherein the handle is operative to hold and release the photoreceptor sheet from the drum.

In some embodiments, at least one of the first or the second holding surfaces is pre-loaded by a wave spring.

In some embodiments, the device applies a holding force at least 250 Kg on the photoreceptor sheet.

In some embodiments, the device is configured for providing an electrical path between the photoreceptor sheet and the drum.

According to some embodiments of the present invention, a holding mechanism is integrated onto a photoreceptor drum of an electro-photography printing device and implemented to removably lock a photoreceptor sheet onto the photoreceptor drum. Reference is now made to FIGS. 1-3A showing a holding device 150 configured for locking a photoreceptor sheet onto the photoreceptor drum, a longitude sectional view of the holding device and a cross-sectional view of the holding device according to some embodiments of the present invention. According to some embodiments of the present invention, holding device and/or locking mechanism 150 includes a shaft 210, a clamping element 110, e.g. a lower clamping element, a clamping element 120, e.g. an upper clamping element, and a spring 250. According to some embodiments of the present invention, holding device 150 is configured to receive an edge of a photoreceptor sheet 105 through a cavity 130 and to hold the edge of the sheet between clamping element 110 and clamping element 120 positioned at an end of cavity 130. In some exemplary embodiments, cavity 130 is formed by a volume between an extrusion 133 and an extrusion 136 of the holding device.

According to some embodiments of the present invention, holding device 150 includes a slider 240 that is configured to adjust the pre-loading force in spring 250. In some exemplary embodiments, a set screw 310 pushes slider 240 so as to push down on spring 250 and thereby increase the pre-load force. Releasing the force on slider 240 with set screw 310 reduces the pre-loading in spring 250. According to some embodiments of the present invention, a return spring 115 may be included to separate clamping element 110 and 120.

According to some embodiments of the present invention, while the holder is in open position, there is a gap between sliders 120 and 110, which allow the photoreceptor sheet to enter between them. According to some embodiments of the present invention, during an open state, return spring 115 may separate clamping element 110 and 120. In this position, the return spring separates the clamping elements so that the photoreceptor sheet 105 may be inserted between the clamping elements. According to some embodiments of the present invention, during an open state, set screw 310 is adjusted to push slider 240 so as to push down on spring 250 and thereby set the desired the pre-load force. In one exemplary embodiment, set screw 310 is adjusted so that the tip and/or tapered portion of push slider 240 slides until touching a wall of extrusion 133.

According to embodiments of the present invention, during the open position, the photoreceptor sheet 105 may be inserted through volume and/or cavity 130 between the clamping elements 110 and 120 and up until a wall of extrusion 133.

During initiation of a locking state of holding device 150, shaft 210 is rotated clockwise and, in response to the rotation, clamping element 110 approaches clamping element 120 in a substantially perpendicular direction with respect to the end surfaces of clamping element 110 and clamping element 120. As clamping element 110 approaches clamping element 120, clamping element 110 presses against clamping element 120 which is typically pre-loaded by a spring 250. During a locking state of holding device 150, clamping element 110 and clamping element 120 presses against the edge of the photoreceptor sheet which is inserted between them. According to some embodiments of the present invention, during initiation of a release state of holding device 150, shaft 120 is rotated counter clockwise again and in response to this rotation, clamping element 110 recedes from clamping element 120 in a substantially perpendicular direction with respect to the end surfaces of clamping element 110 and clamping element 120 the gap between them is created and releases the hold on the photoreceptor sheet. Since the clamping elements do not traverse the surface of the photoreceptor sheet, the force that can be applied is not limited as it is in the prior art by stresses in the photoreceptor sheet caused by such sliding.

Figure 3A:
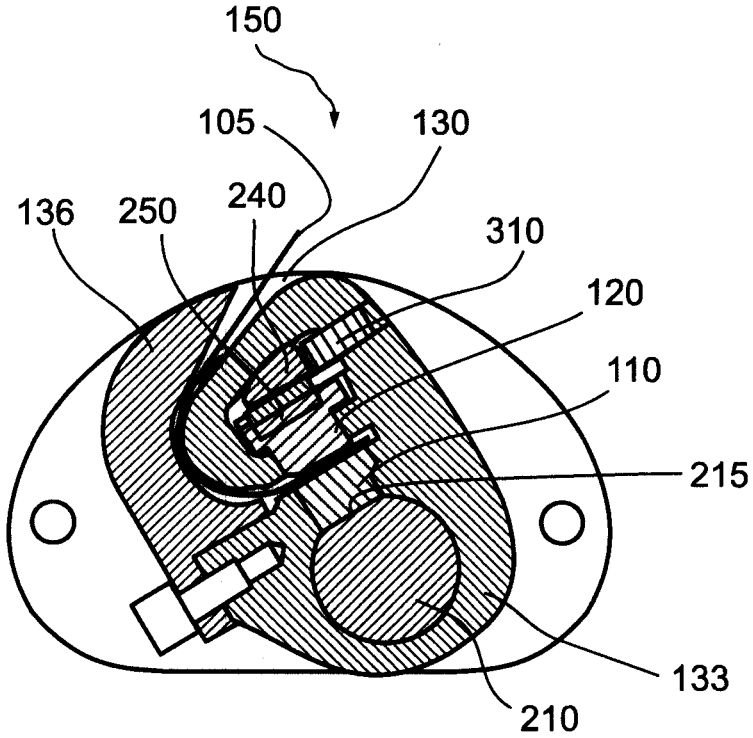
FIG. 3A is a cross-sectional view of a holding device according to some embodiments of the present invention.

In some exemplary embodiments, clamping element 110 is configured to rest on shaft 210 with a surface opposite to the surface engaging the photoreceptor sheet. Typically, spring 250 is positioned over clamping element 120 on a surface opposite the surface of clamping element 120 that engages the photoreceptor sheet. In some embodiments of the invention, rotatable shaft 210 has a substantially cylindrical circular cross section with a section sliced off, as shown in FIG. 3A. The sliced off section forms a substantially flat surface 215. By rotating shaft 210, the shaft moves from touching clamping element 110 on flat surface 215 to touching clamping element 110 on its circular circumference. As a result, clamping element 110 translates toward the photoreceptor sheet positioned between clamping element 110 and clamping element 120 and pushes against clamping element 120. Optionally, the edge of the sliced off section may be rounded to facilitate smooth movement of clamping element 110 as shaft 210 is rotated. Optionally, the rotatable shaft has cylindrical oval cross section or an eccentric cross section that facilitates sliding clamping element 110 toward and away from clamping element 120 in response to rotation of the shaft.

The present inventors have found that the clamping element structure of holding device 150 facilitates higher and more uniform pressure on the sheet as compared to prior art devices.

In some exemplary embodiments, clamping element 120 is pre-loaded by spring 250. Pre-loading the clamping element with a spring increases the grip on the photoreceptor sheet and improves the uniformity of the force distribution over the edge of the sheet that is engaged by the holding device. In some exemplary embodiments of the present invention, spring 250 is a wave spring that extends over the length of the holding device. In one exemplary embodiment, spring 250 may comprise a leaf spring that extends over the length of holding device. In another exemplary embodiment, spring 250 comprises a series of springs positioned over the length of the holding device.

According to some embodiments of the present invention, the pre-load adjustment mechanism including set screw 310 and slider 240 facilitates pre-loading the wave spring 250 after assembly of clamping elements 110 and 120 and slider 240 inside the extrusion 133. In some exemplary embodiments, the assembly of the elements of the holding device, e.g. clamping elements 110 and 120 and slider 240, absent of the pre-load force provides for easier assembly.

According to some embodiments of the present invention, holding device 150 can apply a holding force of approximately 250 Kg and/or 70 MPa, although lesser or greater force can be used depending on the stress to which the photoreceptor sheet is subjected during printing.

Typically clamping elements 110 and 120 are rigid elements with flat surfaces. Optionally, clamping elements 110 and 120 may include ridges and/or protrusions etched and/or in some way formed onto a surface of the clamping elements, e.g. a surface of the clamping elements engaging the sheet, so that the ridges are forced into the sheet and hold it more securely. In some exemplary embodiments, clamping elements 110 and 120 may be coated, e.g. coated with a material to improve hold on the photoreceptor sheet, for example by increasing friction with the sheet.

According to some embodiments of the present invention, shaft 210 and a surface of the slider 110 resting on the shaft are coated with a material to minimize friction during rotation of shaft. In some exemplary embodiments, shaft 210 and the bottom surface of clamping element 110 are coated with chrome and/or nickel.

Figure 3B:
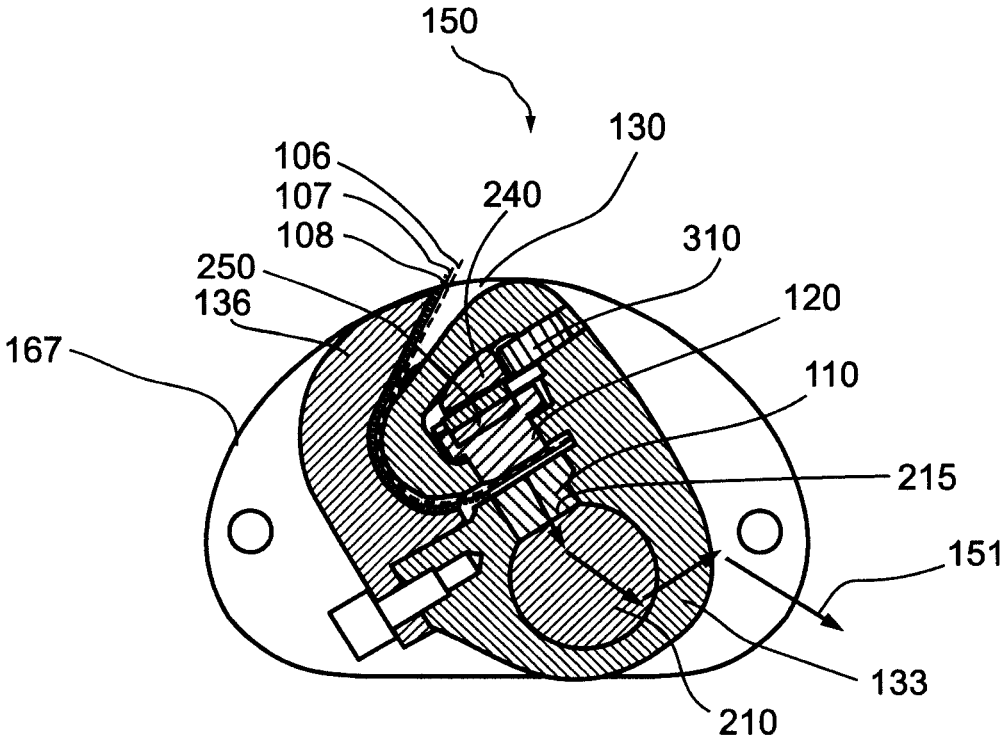
FIG. 3B is a schematic illustration of an electrical grounding path of a metallic layer of the photoreceptor sheet through the holding device according to some embodiments of the present invention.

Reference is now made to FIG. 3B showing an electrical grounding path of a metallic layer of the photoreceptor sheet through the holding device to the drum according to some embodiments of the present invention. Typically, the photoreceptor sheet includes three layers, layer 106, 107, and 108 of which the middle layer 107 of the sheet is a metal layer and layers 106 and layer 108 are non-metallic. According to some embodiments of the present invention, upon engagement of the sheet with holding device 150, the sheet is in electrical contact with the drum through the holding device. According to some embodiments of the present invention, the metal layer of the sheet is exposed on the leading edge of the sheet, e.g. the edge of sheet 105 that is held by holding device 150 and when engaged in the holding device establishes electrical contact with clamping element 110. Typically, clamping element 110 is fabricated from an electrically conducting material, e.g. a metallic material without any non-conductive coatings. According to some embodiments of the present invention, a grounding path 151 is established from the exposed edge of sheet 105, through clamping element 110, shaft 210, extrusion 133, flange 167, to the drum. Shaft 210, extrusion 133, and flange 167 are fabricated from electrically conducting material and are in electrical contact with each other.

Figure 4:
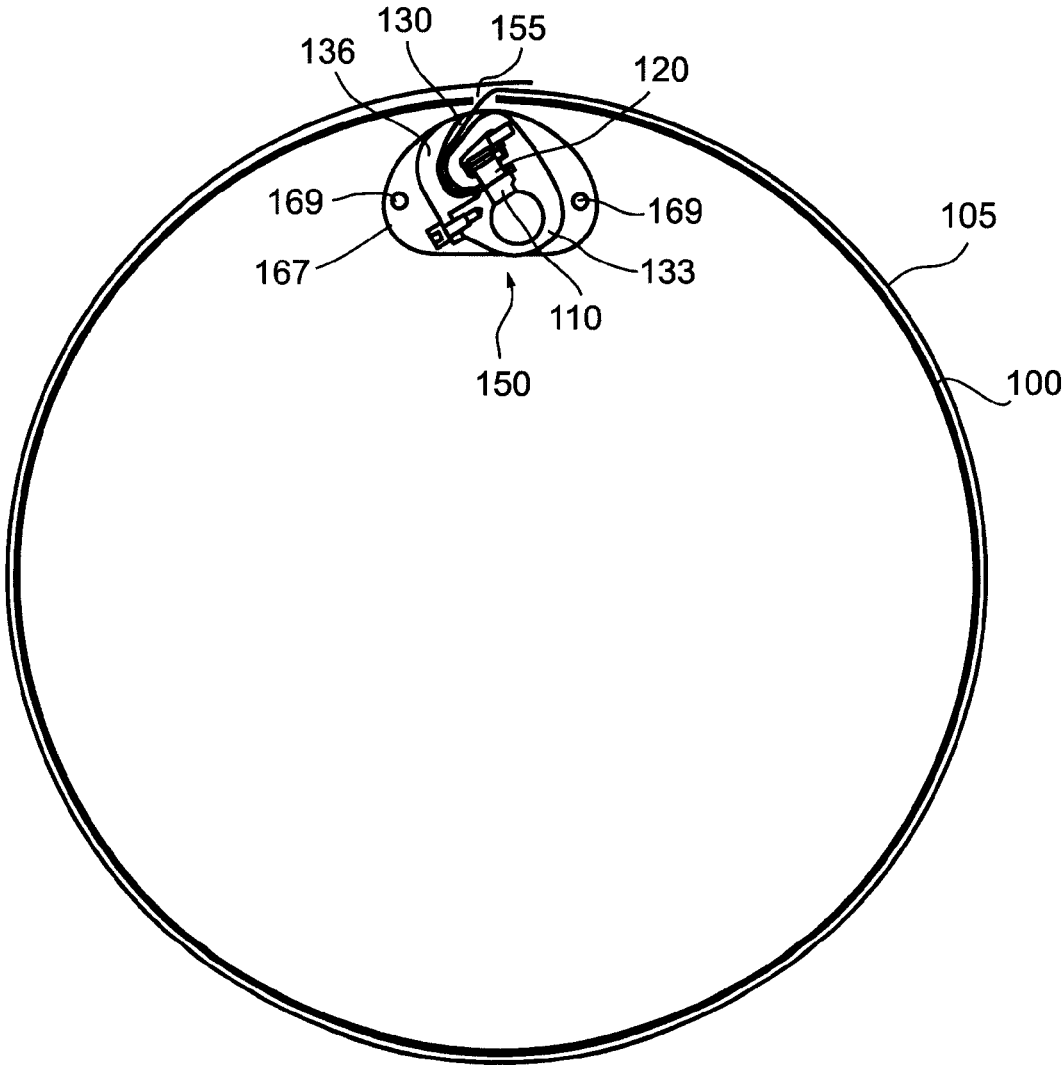
FIG. 4 is a schematic illustration of a photoreceptor mounted on a drum with a holding device according to some embodiments of the present invention.

Reference is now made to FIG. 4 showing a schematic illustration of a photoreceptor sheet mounted on a drum and locked into place with a holding device according to the embodiment of the present invention described above with respect to FIGS. 1-3. According to some embodiments of the present invention, holding device 150 is integrated into a drum 100. Holding device 150 is positioned on drum 100 proximal to a slot 155 on the perimeter of the drum. Holding device 150 is positioned on drum 100 so that slot 155 forms an entryway into cavity 130 of holding device 150.

To mount photoreceptor sheet 105 onto the drum, one end of the sheet is inserted into slot 155 and thus into cavity 130 so that sheet 105 is positioned between clamping element 110 and clamping element 120 at the end of cavity 130.

According to some embodiments of the present invention, the outer surface of drum 100 as well as extrusions 133 and 136 are shaped near slot 155 to provide a slope so that the insertion of the photoreceptor sheet is facilitated. Further, in some exemplary embodiments, the other end of the photoreceptor sheet extends long enough to overlay slot 155 so as to avoid liquid toner entering cavity 130. According to some embodiments of the present invention, the photoreceptor sheet is a foil, e.g. a thin foil. In some exemplary embodiments, the sheet thickness ranges between 0.07 and 0.11 mm, e.g. 0.078-0.079 mm, approximately 0.08 mm, approximately 0.09 mm and/or 0.093 mm.

According to some embodiments of the present invention, the holding device provides improved ability to clean residual material from the photoreceptor sheet that may get stuck inside the holding device. For example, the holding device can be easily assembled and disassembled from the drum by two or more screws 169 on flange 167 for cleaning. In some exemplary embodiments, once the holding device is disassembled an air pressure gun pointed to cavity 130 may be used to remove residuals that may get stuck inside the holding device. In some exemplary embodiments, the holding device may be disassembled and cleansed, e.g. the sliders, wave spring and shaft may be disassembled for cleaning. Typically, cleaning of the holding device may be performed on site, e.g. the cleaning may take approximately 10 minutes to an hour during which the printer cannot print. This is an improvement over previously known holding devices where the disassembly of the holding device is more difficult and cleansing of the holding device is typically performed in the lab and not on site. During this time, the printer cannot be used.

Figure 5:
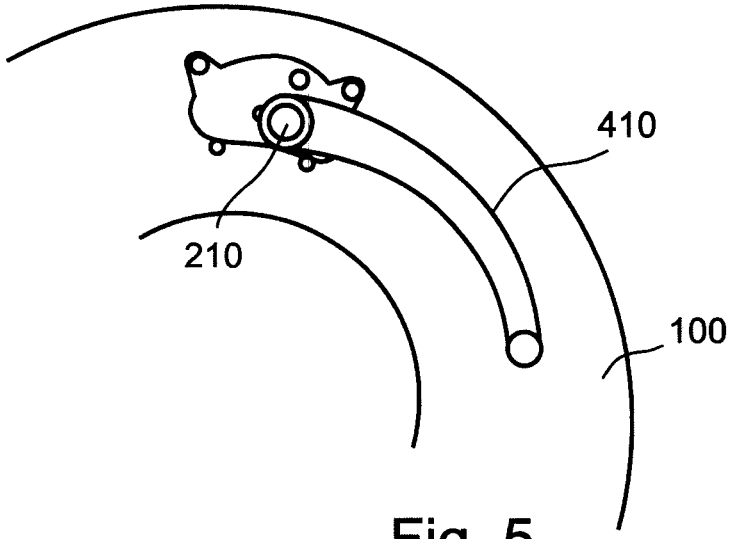
FIG. 5 is a schematic illustration of a handle for removably mounting a photoreceptor sheet onto a drum according to some embodiments of the present invention.

Reference is now made to FIGS. 5 and 6 showing schematic illustrations of a handle for removably mounting a photoreceptor sheet onto a drum according to some embodiments of the present invention. According to some embodiments of the present invention, handle 410 is rigidly connected to shaft 210. Rotating shaft 210 with handle 410 in a counter-clockwise direction orients flat surface 215 of shaft 210 so that it faces and/or touches clamping element 110. Clamping element 110 rests on shaft 210 and therefore recedes from clamping element 120 and photoreceptor 105 and rests on the flat surface 215 currently facing clamping element 110. In the open position, photoreceptor 105 may be inserted and/or removed from the holding device, e.g. for replacement. Rotating shaft 210 with handle 410 in a clockwise direction provides orienting a substantially circular surface of shaft 210 so that it faces and touches clamping element 110. Clamping element 110 is configured to rest on shaft 210 and therefore is pushed toward clamping element 120 and photoreceptor 105. The radius of the circular portion of the cross section of shaft 210 is larger than the radius of the flat portion of the cross section. The change in radius between the circular and flat portions initiates sliding of clamping element 110 toward and away from clamping element 120 and the photoreceptor sheet between them.

In the closed position, photoreceptor 105 is clamped and fixed onto drum 100. One or more stoppers may be provided to limit the rotation of handle 410 between the open and closed state of the handle. A mechanism to lock the handle in a closed position may be included. The position of handle 410 as shown in FIG. 5 is optionally a closed position of the handle. The closed position on the handle is such that the handle will not obstruct operation of the printer, e.g. while the drum is rotating. In some exemplary embodiments of the present invention, the handle may have a length between 5-20 cm, e.g. 6 cm or 12 cm. The force on the handle to operate opening and closing may range between 10-150 N depending on the length of the handle and the force on the pre-load springs. For example, for a spring force of approximately 1300 N, a force approximately between 10-70N on the handle may be employed for a handle having a length of 6 cm. For larger spring forces, e.g. 4000 N, a longer handle may be used, e.g. 12 cm with a force on the handle of approximately 10-80 N.

Figure 6A:
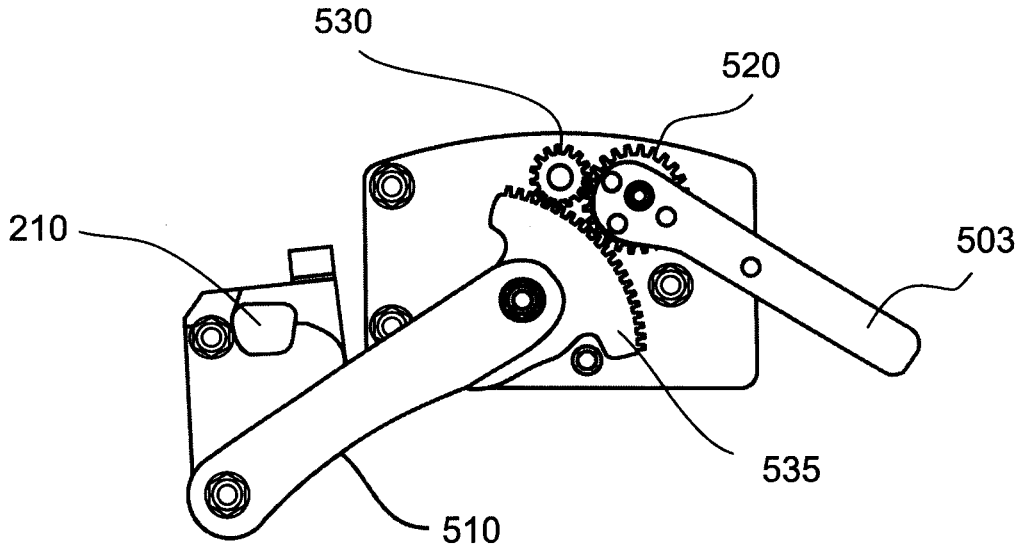
FIGS. 6A and 6B are schematic illustrations of a handle on the holding device for removably mounting a photoreceptor sheet onto a drum according to some embodiments of the present invention.
Figure 6B:
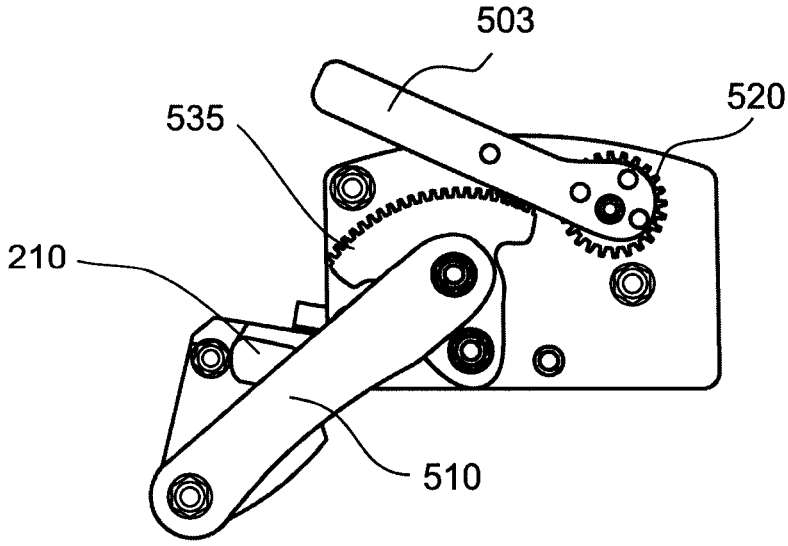

Reference is now made to FIGS. 6A and 6B showing schematic illustrations of a handle on a holding device for removably mounting a photoreceptor sheet onto a drum according to some embodiments of the present invention. In FIG. 6A the handle is in a closed position and in FIG. 6B the handle is in an open position. According to some embodiments of the present invention, a gear transmission may be used to reduce the force applied to the handle for operation. One or more gears, e.g. gears 520, 530, and 535 may be used for this purpose. According to some exemplary embodiments of the present invention, lifting handle 503 serves to rotate shaft 210 in a clockwise direction so that flat surface 215 of shaft 210 is oriented to face clamping element 110. Lowering lever 503 serves to rotate shaft 210 in a counter-clockwise direction so that the circular portion of the cross section of shaft 210 is oriented to face clamping element 110. In one exemplary embodiment, the number of teeth in gear 535 is 80, the number of teeth in gear 530 is 16 and the number of gear teeth in gear 520 is 24, facilitating a gear reduction of 80/24. According to an exemplary embodiment, the addition of lever 510 may facilitate a reduction of approximately 8 giving a combined force reduction of 11.33. Typically, handle 503 is shorter than handle 410 used in the handle mechanism shown in FIG. 5, for example the handle may be half the length so that the overall force reduction as compared to a simpler handle mechanism shown in FIG. 5 may be approximately 5-6. Other gear ratios and handle mechanisms may be implemented to achieve various force reductions.

It should be further understood that the individual features described hereinabove can be combined in all possible combinations and sub-combinations to produce exemplary embodiments of the invention. Furthermore, not all elements described for each embodiment are essential. In many cases such elements are described so as to describe a best more for carrying out the invention or to form a logical bridge between the essential elements. The examples given above are exemplary in nature and are not intended to limit the scope of the invention which is defined solely by the following claims.

The terms "include", "comprise" and "have" and their conjugates as used herein mean "including but not necessarily limited to".

The invention claimed is:

1. A device for holding a photoreceptor sheet onto a drum of an electro-photography printing device comprising:

first and second clamping elements comprising first and second holding surfaces, respectively, to hold an edge of the photoreceptor sheet from opposite directions by pressing against the sheet in a substantially perpendicular direction with respect to the surface of the sheet, in which at least the second clamping element is pre-loaded with a first spring biasing the second holding surface toward the first holding surface; and in which the first and second holding surfaces are engaged with the photoreceptor sheet via a rotatable shaft mechanically coupled to the first clamping mechanism, the rotatable shaft, when rotated, moving the first clamping mechanism relative to the second clamping mechanism, in which the shaft comprises a cross sectional shape comprising a circular portion and a flat portion.

2. The device according to claim 1, wherein the first clamping element engages with and disengages from the second holding surface in response to rotation of the shaft.

3. The device according to claim 2 wherein the first clamping element recedes from the second clamping element in response to the first clamping element resting on the flat portion of the shaft.

4. The device according to claim 1 wherein the first holding surface is pre-loaded by a second spring, the second spring being biased to separate the first and second holding surfaces.

5. The device according to claim 1 wherein the first spring is a wave spring.

6. The device according to claim 5 wherein the length of the first spring corresponds to at least the length of the edge of the photoreceptor sheet.

7. The device according to claim 1 wherein the first spring is a leaf spring.

8. The device according to claim 1 wherein the first spring rests on the second clamping element on a surface opposite the holding surface of the second clamping element.

9. The device according to claim 1 comprising:

a sliding element at least partially resting on the first spring; and a set screw configured to translate the sliding element over the first spring.

10. The device according to claim 9 wherein the sliding element and the set screw are configured for adjusting the pre-load of the first spring.

11. The device according to claim 1 wherein the drum includes a slot on the perimeter of the drum and wherein the device is positioned on the drum proximal to the slot so that the slot forms an entryway into the device.

12. The device according to claim 1, further comprising a handle fixed to the rotatable shaft, wherein the handle is operative to rotate the shaft to engage and disengage the photoreceptor sheet from the drum.

13. The device according to claim 1 wherein the photoreceptor sheet is a foil.

14. The device according to claim 1 wherein the photoreceptor sheet has a thickness between 0.07 and 0.11 mm.

15. The device according to claim 1 wherein the device applies a holding pressure of at least 70 MPa.

16. The device according to claim 1 wherein the device is configured for removably fixing the photoreceptor sheet onto the drum.

17. The device according to claim 1 wherein the device creates an electrical ground between the photoreceptor sheet and the drum.

18. A device for holding a photoreceptor sheet onto a drum of an electro-photography printing device comprising:

first and second clamping elements comprising first and second holding surfaces, respectively, to hold an edge of the photoreceptor sheet from opposite directions by pressing against the sheet in a substantially perpendicular direction with respect to the surface of the sheet; and a handle associated with the holding device, wherein the handle is operative to hold and release the photoreceptor sheet from the drum, in which the second clamping element comprises:

a first spring biasing the second holding surface toward the first holding surface;

a sliding element resting on the first spring; and a set screw to translate the sliding element over the first spring, in which the sliding element and set screw adjust the pre-load the first spring.

19. The device according to claim 18 in which the first spring is a wave spring.

20. The device according to claim 18 wherein the device applies a holding pressure of at least 70 MPa on the photoreceptor sheet.

21. The device according to claim 18 wherein the device is configured for providing an electrical path between the photoreceptor sheet and the drum.

22. A device for holding a photoreceptor sheet onto a drum of an electro-photography printing device comprising:

first and second clamping elements comprising first and second holding surfaces, respectively, to hold an edge of the photoreceptor sheet from opposite directions by pressing against the sheet in a substantially perpendicular direction with respect to the surface of the sheet, in which the second clamping element comprises:

a first spring biasing the second holding surface toward the first holding surface;

a sliding element mechanically coupled to the first spring; and a set screw to translate the sliding element over the first spring, in which the sliding element and set screw adjust the pre-load the first spring.

* * * * *

UNITED STATES PATENT AND TRADEMARK OFFICE

CERTIFICATE OF CORRECTION

PATENT NO. : 8,615,185 B2
APPLICATION NO. : 12/681011
DATED : December 24, 2013
INVENTOR(S) : Avichay Mor-Yosef et al.

It is certified that error appears in the above-identified patent and that said Letters Patent is hereby corrected as shown below:

In the Claims:

In column 10, line 25, in Claim 18, delete “the” and insert -- of the --, therefor.

In column 10, line 49, in Claim 22, delete “the” and insert -- of the --, therefor.

Signed and Sealed this
Seventeenth Day of June, 2014

Michelle K. Lee

Michelle K. Lee
*Deputy Director of the United States Patent and Trademark Office*